United States Patent [19]

Weiss et al.

[11] Patent Number: 5,036,811

[45] Date of Patent: Aug. 6, 1991

[54] FOUR-STROKE INTERNAL-COMBUSTION ENGINE

[75] Inventors: Eckhard Weiss, Vaihingen; Horst Bergmann, Esslingen, both of Fed. Rep. of Germany

[73] Assignee: Daimler-Benz Aktiengesellschaft, Stuttgart, Fed. Rep. of Germany

[21] Appl. No.: 430,642

[22] Filed: Oct. 31, 1989

[30] Foreign Application Priority Data

Nov. 23, 1988 [JP] Japan ..... 3839449

[51] Int. Cl.[5] ..... F01L 13/06; F02D 9/06

[52] U.S. Cl. ..... 123/323; 123/324

[58] Field of Search ..... 123/324, 323, 320, 322, 123/321, 315, 316; 188/273

[56] References Cited

U.S. PATENT DOCUMENTS

| | | | |
|---|---|---|---|
| 4,205,639 | 6/1980 | Kawase et al. | 123/323 |
| 4,662,332 | 5/1987 | Bergmann et al. | 123/323 |
| 4,856,474 | 8/1989 | Tisch | 123/323 |

FOREIGN PATENT DOCUMENTS

| | | | |
|---|---|---|---|
| 1207704 | 12/1965 | Fed. Rep. of Germany . | |
| 3428626 | 2/1986 | Fed. Rep. of Germany . | |
| 57-171011 | 10/1982 | Japan | 123/323 |
| 859800 | 1/1961 | United Kingdom | 123/320 |

*Primary Examiner*—Andrew M. Dolinar

*Attorney, Agent, or Firm*—Evenson, Wands, Edwards, Lenahan & McKeown

[57] ABSTRACT

A four-stroke internal-combustion engine for a motor vehicle having inlet and exhaust valves is provided with additional outlet valves for each cylinder, which valves are adjustable by means of an actuating device and with a throttle flap arranged in the exhaust outlet, also adjustable by means of an actuating device. The actuating devices are operated by at least one directional valve, in response to actuation of a brake switch. Braking of the internal-combustion engine occurs as a result of the opening of the additional outlet valves and a throttling of the exhaust gases during the braking operation. The braking of the internal-combustion engine is speed-dependent in that engine braking is cancelled below a minimum specified speed.

5 Claims, 1 Drawing Sheet

FOUR-STROKE INTERNAL-COMBUSTION ENGINE

BACKGROUND AND SUMMARY OF THE INVENTION

The invention relates to a four-stroke internal-combustion engine for driving a motor vehicle having inlet and outlet charge exchange valves and with an additional outlet valve, adjustable by means of an actuating device and intended for each cylinder; and with a throttle flap arranged in the outlet channel of the internal-combustion engine, adjustable by means of an actuating mechanism. The actuating devices and mechanism are actuable by at least one directional valve adjustable in dependence on a brake switch. At speeds above a predetermined limiting speed, a braking of the internal-combustion engine occurs as a result of the opening of the additional outlet valves and by a throttling of the exhaust gases.

German Offenlegungsschrift 3,428,626 makes known a four-stroke internal-combustion engine, in which braking is brought about by virtue of the fact that during the entire braking operation, compressed air is conveyed out of the cylinder space into the outlet channel of the internal-combustion engine via additional outlet valves actuated by an adjusting device and wherein the exhaust gases of the internal-combustion engine are throttled by a throttle flap adjustable by means of an actuating device, located in the outlet channel of the internal-combustion engine. The adjusting device and the actuating device are controlled by a directional valve operable in dependence on the brake pedal. As a result of the actuation of the brake pedal, depending on the directional valve, the actuation of the additional outlet valves and of the exhaust-gas throttle flap can take place in any sequence and combination.

When the additional outlet valves are open, engine ignition is no longer possible. The result of this is that the engine can die, if at the same time, it is running in the idling range.

The object of the invention is to design an internal-combustion engine of the above general type, so that reliable engine running is guaranteed over the entire speed range and without detriment to the braking of the vehicle.

According to the invention, the object is achieved by virtue of the fact that the engine braking is cancelled below a specific speed limit.

For this purpose, in the control circuit of the engine brake there is a speed switch which prevents either the opening of the additional outlet valves and/or additionally the closing of the exhaust-gas throttle flap when the speed of the internal-combustion engine falls below a lower limiting value. In the idling range of the internal-combustion engine, the effect of the engine brake is thus at least partially cancelled and the engine is reliably prevented from dying.

The additional exhaust valves can discharge directly into the exhaust channel or directly into the ambient air and by-passing the exhaust channel.

It is advantageous if the actuating controls are controlled by a pressure medium (air or oil) in response to movement of an operated control valve. Separate control of the throttle and additional exhaust valves can be obtained by utilizing two control valves.

Other objects, advantages and novel features of the present invention will become apparent from the following detailed description of the invention when considered in conjunction with the accompanying drawings.

DETAILED DESCRIPTION OF THE DRAWINGS

Figure 1:
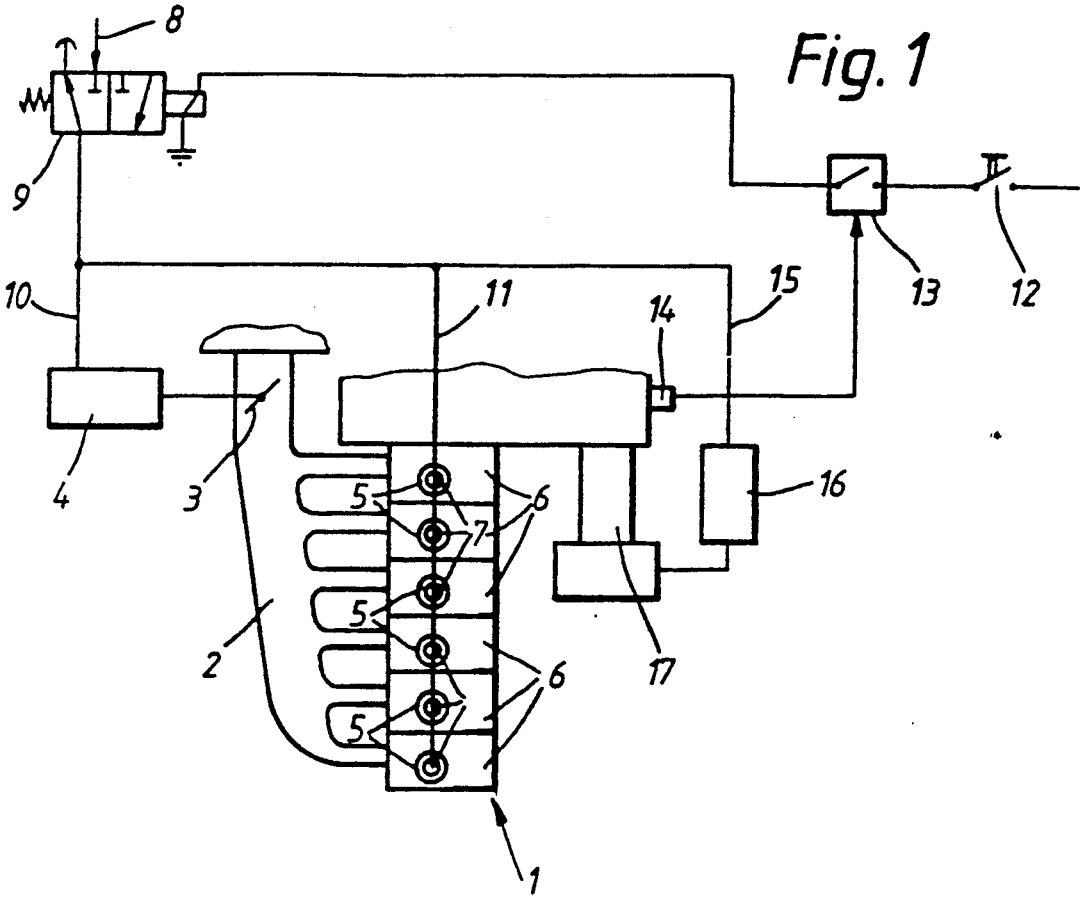
FIG. 1 shows diagrammatically the design of an internal-combustion engine according to the invention.

FIG. 1 shows (diagrammatically) a 6-cylinder in-line internal-combustion engine 1 with an exhaust outlet channel 2. In this outlet channel 2 there is a throttle flap 3 which can be adjusted via an actuating device 4. In addition to engine braking by throttling of the exhaust gas by the throttle flap 3, engine braking is obtained in a known way by opening an additional exhaust outlet valve 5 for each of the cylinders 6 of the internal-combustion engine 1. These additional outlet valves 5 each have their own actuating device 7. A directional valve 9, is connected to an auxiliary pressure force through a feed line 8. Both the actuating device 4 of the throttle flap 3 (via a control line 10) and the actuating device 7 of the additional outlet valves 5 (via a control line 11) are actuated by the pressure coming from directional valve 9. Whenever the engine-brake switch 12 is actuated, the directional valve 9, (provided that the speed switch 13 that is located in the control path of the valve is in its closed position) changes over to its through-flow working position and feeds the auxiliary pressure force (compressed air or pressure oil) to the actuating devices 4 and 7 via the feed line 8 and the control lines 10 and 11. As a result of the actuation of these actuating devices 4 and 7, the throttle flap 3 moves into its closing position to throttle exhaust flow in the outlet channel and the additional outlet valves 5 open, in order to transfer compressed air from the cylinders 6 into the outlet channel 2 of the internal-combustion engine 1 or directly to atmosphere by-passing the outlet channel 2. Engine braking takes place in this way. During the engine braking, an adjusting device 16 is actuated via the directional valve 9 and a control line 15 and cuts off the fuel feed to the injection pump 17.

When a speed transmitter 14, located on the internal-combustion engine 1, detects that the speed has descended into the idling range (by falling below a lower speed limit) the speed switch 13 is brought into its open position and thus interrupts the activation of the directional valve 9, independently of the position of the brake switch 12. The directional valve 9 returns to its closed position of rest, with the result that the pressure in the control lines 10, 11 and 15 is reduced and the throttle flap 3 is opened and/or the additional outlet valves 5 are closed. At the same time, fuel is fed to the injection pump 17 once more. The possibility that an idling or slow running internal-combustion engine 1 will die because of a lack of ignition caused by open additional outlet valves, or by too high an exhaust-gas counterpressure is thereby excluded. The operating behavior of the internal-combustion engine 1 in the idling range thus corresponds exactly to the operating behavior without engine braking. The engine brake is available again only when the speed of the internal-combustion engine 1 has once more exceeded the lower limiting speed value.

Figure 2:
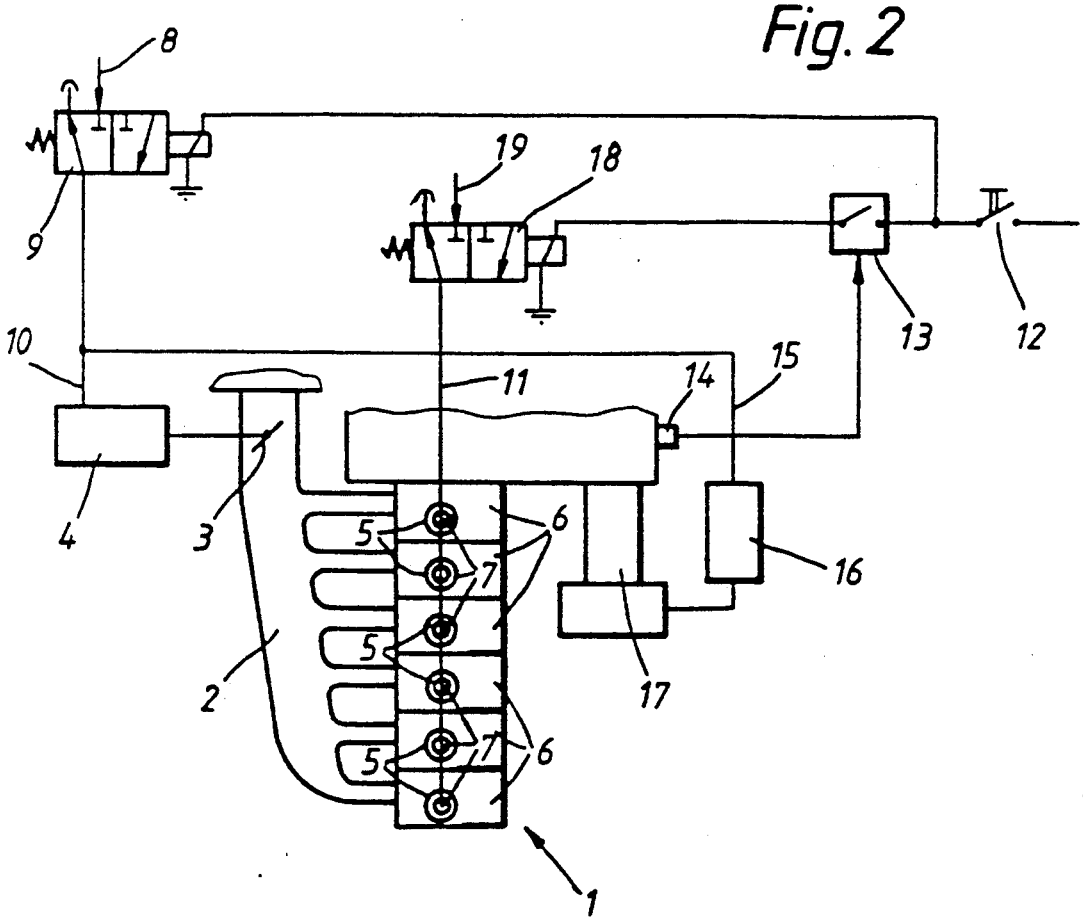
FIG. 2 shows diagrammatically a second design of the internal-combustion engine according to the invention.

The arrangement according to FIG. 2 basically corresponds to that described with reference to FIG. 1. Identical parts bear the same reference symbols. In contrast to the arrangement shown in FIG. 1, in this embodiment the actuating devices 7 of the additional outlet valves 5 are not activated jointly with the actuating device 4 of the throttle flap 3, but are activated separately therefrom via a second directional valve 18 which is supplied with the auxiliary pressure force via the feed line 19. When the speed switch 13 opens, that is when the engine speed falls below the lower limiting speed value and enters the idling range, only the directional valve 15 for the additional outlet valves 5 returns to its position of rest, but not the directional valve 9 for the throttle flap 3. Thus, when the brake pedal 12 is actuated in the idling range of the internal-combustion engine 1, the braking effect obtained by the exhaust-gas throttle flap 3 is preserved. The internal-combustion engine 1 is prevented from dying because, in this engine operating range, the additional outlet valves 5 are always in the closed position.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. Four-stroke internal-combustion engine for driving a motor vehicle having inlet and outlet charge exchange valves, comprising a brake switch; a speed switch operatively associated with the engine; an additional outlet valve for each cylinder of the engine, with each additional outlet valve being adjustable by an actuator; and a throttle flap arranged in an outlet charge exhaust channel of the internal-combustion engine and adjustable by an actuating device;

each actuator and actuating device being controlled by at least one directional valve, operatively connected to and adjustable in dependence on the brake switch and the speed switch;

wherein at engine speeds above a predetermined lower limiting speed, a braking of the internal-combustion engine occurs during a braking operation as a result of each actuator opening the additional outlet valves and the actuating device operating the throttle to throttle exhaust gases in response to the directional valve, and at engine speeds below the predetermined lower limiting speed the actuators are deactuated via the speed switch to deactuate at least the additional outlet valves in order to close said valves such that at least some braking is maintained.

2. Internal-combustion engine according to claim 1, wherein each actuator and device can be subjected to compressed air via the directional valve which is electrically activatable.

3. Internal-combustion engine according to claim 1, wherein each additional outlet valve exhausts into one of the outlet channel and ambient air so as to by-pass the outlet channel.

4. Internal-combustion engine according to claim 2, wherein each additional outlet valve exhausts into one of the outlet channel and ambient air so as to by-pass the outlet channel.

5. Internal-combustion engine according to claim 2, wherein the at least one directional valve is electrically switched between two positions, whereby in one position the compressed air is supplied to each actuator and the actuating device, and in the other position, each actuator and the device as connected with ambient air.

* * * * *